United States Patent [19]

Wells

[11] 4,091,795

[45] May 30, 1978

[54] COOKING ADAPTER

[76] Inventor: James W. Wells, 2140 Oleander Dr., Lexington, Ky. 40504

[21] Appl. No.: 720,134

[22] Filed: Sep. 3, 1976

[51] Int. Cl.[2] ..... F24C 5/04

[52] U.S. Cl. ..... 126/258

[58] Field of Search ..... 126/38, 24, 47, 258, 126/260, 265, 267

[56] References Cited

U.S. PATENT DOCUMENTS

| | | | |
|---|---|---|---|
| 1,585,106 | 5/1926 | Pederson | 126/258 X |
| 2,893,373 | 7/1959 | Rundle | 126/9 R |
| 3,133,536 | 5/1964 | Knapp | 126/258 |
| 3,154,065 | 10/1964 | Bencoe | 126/260 X |
| 3,408,998 | 11/1968 | Brancato et al. | 126/47 X |
| 3,804,075 | 4/1974 | Rummel | 126/258 |
| 3,960,134 | 6/1976 | Scott | 126/24 |

*Primary Examiner*—Edward G. Favors
*Attorney, Agent, or Firm*—Wood, Herron & Evans

[57] ABSTRACT

A cooking adapter structured to rest on the top of a gas fired lantern, and to make use of the heat generated by that lantern for cooking purposes. The lantern's top is in the form of a hat-shaped structure having heat exhaust ports in the crown portion thereof. In preferred form, the cooking adapter includes a cylindrical tube having a grid fixed in place transverse to the axis of the sleeve at a location about midway between the ends of the sleeve. The bottom half of the sleeve is provided with an annular insulated wall, the grid being supported on that annular wall. The sleeve's insulated wall portion is sized to cooperate with the crown and brim portions of the lantern's top to support the sleeve on that top in spaced relation to the heat exhaust ports in the top's crown portion. In use, the cooking adapter is simply seated on top the gas fired lantern, a cooking implement then being placed on the grid to expose that implement to the heat which exhausts through the lantern top's heat exhaust ports.

6 Claims, 3 Drawing Figures

COOKING ADAPTER

This invention relates to cooking adapters. More particularly, this invention relates to a cooking adapter especially structured for use with a gas fired lantern.

Gas fired lanterns are commonly used in the outdoors when camping. Such gas fired lanterns are used for lighting purposes after dark. One typical gas fired lantern is fired by white gasoline, is known as a Coleman type lantern, and is manufactured and sold by Coleman Company, Inc., 250 N. St. Francis Avenue, Wichita KS, 67202. Other gas fired lanterns may be fired by natural or synthetic gas. For purposes of this application, the term gas fired lantern is deemed to mean any lantern fired by a liquid or gaseous combustible material for purposes of generating visible light.

One prime requisite of a camper's gear is cooking equipment. A camper's cooking equipment should preferably be as light and as compact as possible. Of course, such cooking equipment requires a heat source, that source in portable cooking equipment generally also requiring the use of a liquid or gaseous material. There are structures known to the prior art which adapt a gas fired lantern for cooking purposes. Typical of such structures are those shown in U.S. Pat. Nos. 3,408,998 and 3,773,458. However, all such adapter structures currently known to applicant require some degree of structural modification to the lantern itself.

Accordingly, it has been one objective of this invention to provide a cooking adapter for a gas fired lantern, that adapter being structured to make use of the heat generated by the lantern when same is being operated to provide light therefrom, and without structurally revising the lantern itself.

In accord with this objective, the cooking adapter of this invention is structured to rest on the top of a gas fired lantern, and to make use of the heat generated by that lantern for cooking purposes. The lantern's top is in the form of a hat-shaped structure having heat exhaust ports in the crown portion thereof. In preferred form, the cooking adapter includes a cylindrical tube having a grid fixed in place transverse to the axis of the sleeve at a location about midway between the ends of the sleeve. The bottom half of the sleeve is provided with an annular insulated wall, the grid being supported on that annular wall. The sleeve's insulated wall portion is sized to cooperate with the crown and brim portions of the lantern's top to support the sleeve on that top in spaced relation to the heat exhaust ports in the top's crown portion. In use, the cooking adapter is simply seated on top the gas fired lantern, a cooking implement then being placed on the grid to expose that implement to the heat wich exhausts through the lanter top's heat exhaust ports.

Other objectives and advantages of the invention will be more apparent from the following detailed description taken in conjunction with the drawings in which.

Figure 1:
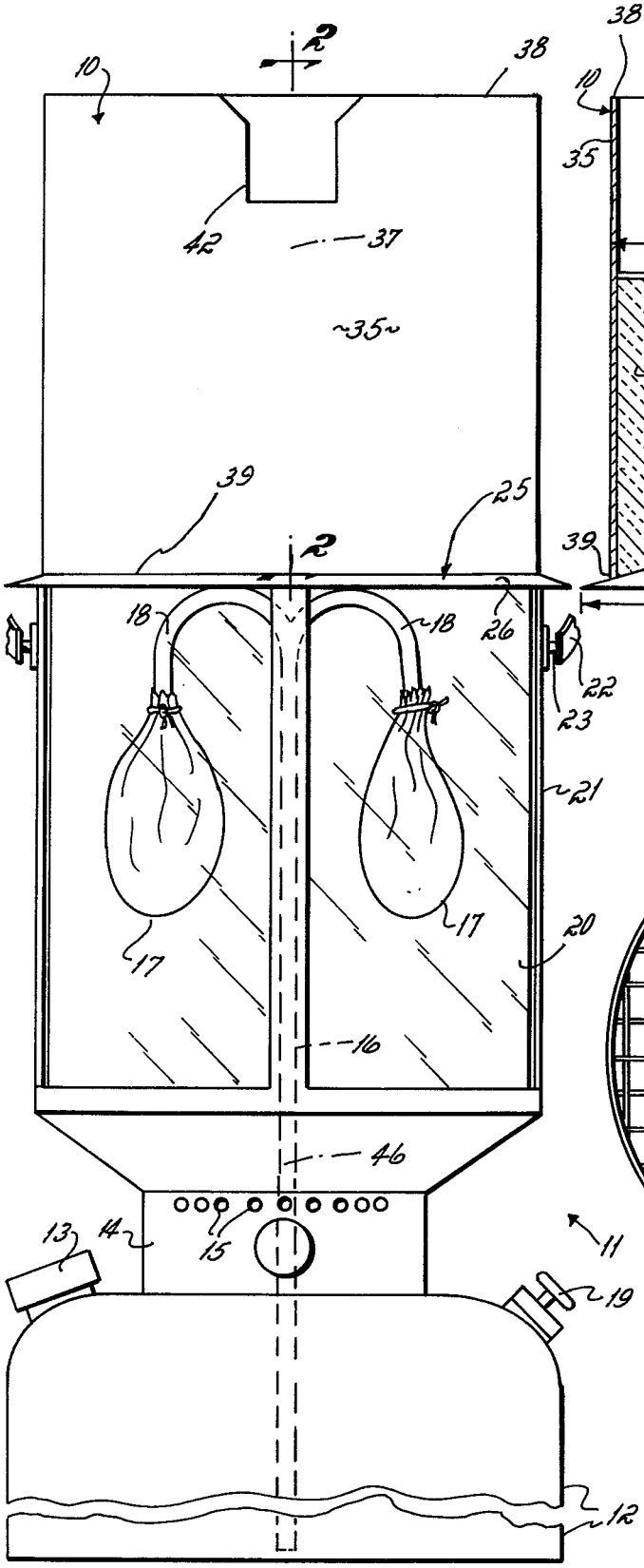
FIG. 1 is a side elevational view illustrating the cooking adapter of this invention in combination with a gas fired lantern.

As illustrated in FIG. 1, the cooking adapter 10 of this invention is structured for use with a gas fired lantern 11 of that type commonly known for outdoor or camp use. The gas fired lantern 11 includes a base 12 which is in the nature of a vessel or tank for liquid fuel, e.g., white gasoline. The tank 12 is filled through an opening that is closed by cap 13, and the fuel in the tank is pressurized by pump 19. The base 12 includes a relatively narrow neck 14 over the tank, the neck being provided with a plurality of air vents 15 so as to give air to the burning fuel. The fuel is fed through center tube 16 where same is gasified and exhausted into two separate mantles 17 through branch feeder sections 18. A cylindrical glass globe 20 fits within framework 21 so as to guard the mantles 17 against exterior interference. The transparency of the globe 20, of course, permits the bright light generated by the mantles 17 to be dispersed so as to illuminate the surrounding area. A U-shaped bale or handle 22 is also connected to the framework 21, as at 23, so as to permit carrying of the lantern. This basic lantern structure 11 is well known to the prior art. One commercial model of this type lantern is sold as a Coleman lantern by Coleman Company, Inc., 250 N. St. Francis Avenue, Wichita KS 67202.

In connection with the lantern 11, and with specific reference to the cooking adapter 10 of this invention, note particularly that the mantles 17 of same are covered by a generally hat-shaped cap 25. The cap 25 includes a downwardly turned brim 26 portion, and a primary crown 24 portion extending upwardly therefrom, the primary crown portion being of a diameter D, and the brim portion being of a diameter D'. Extending upwardly from the primary crown 24 of the hat-shaped cap 25 is a secondary crown portion in the form of a stack 27. The stack 27 includes a plurality of heat exhaust ports 28 dispersed peripherally around on the side wall surface thereof, and is closed at the top by roof 29. The ports 28 in the stack 27 portion of the lantern's cap 25 permit heat generated by the gas fired mantles 17 to exhaust to atmosphere when the cooking adapter of this invention is not in operative combination therewith. This heat is substantial in the normal mantle type lantern 11 referred to above, and it is this heat exhaust that the cooking adapter 10 of this invention makes use of to heat or cook foodstuffs.

Figure 2:
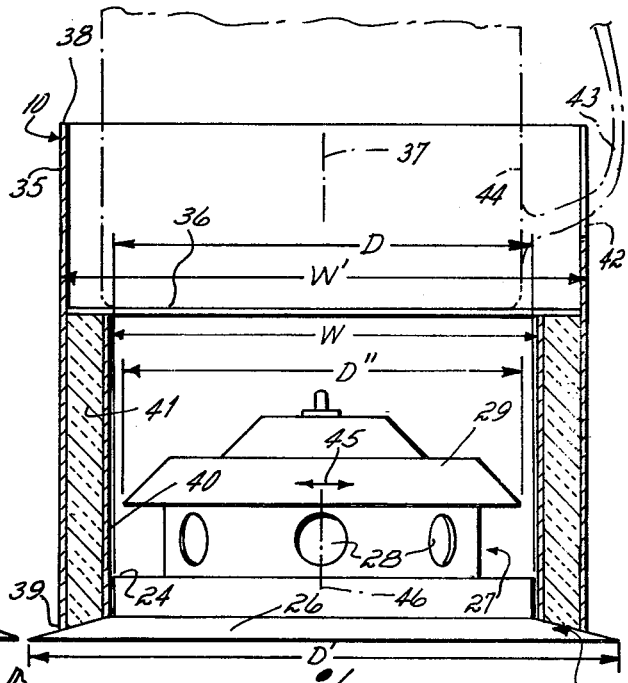
FIG. 2 is a cross-sectional view taken along line 2—2 of FIG. 1.
Figure 3:
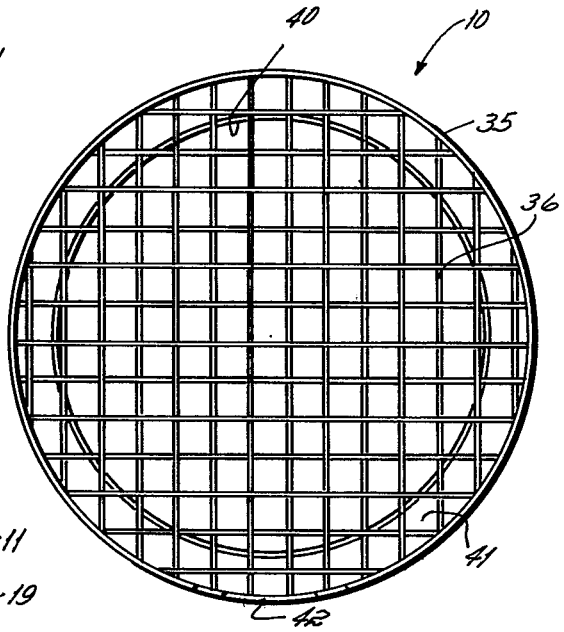
FIG. 3 is a top view of the cooking adapter.

The cooking adapter 10 of this invention is particularly illustrated in FIGS. 1-3. The adapter 10 includes a generally cylindrical or tubular member 35. The tubular member or sleeve 35 has a wire mesh type grid 36 fixed in place transverse to the axis 37 thereof at a location about midway between the top and bottom end edges 38, 39, respectively, of the sleeve. The bottom half of the sleeve 35 is provided with an inside tubular wall 40, the annular space between the inner wall 40 and the sleeve 35 being filled by an insulation material 41 such as asbestos sheeting. The wire grid 36 is supported on that so-formed annular wall. The upper portion of sleeve, above the wire grid 36, carries no insulation. A notch 42 is provided in the top edge 38 of the sleeve 35 to accommodate the handle 43 of a coffee pot, a skillet, a cooking pot 44, or the like, when that implement is in operational position on the grid.

Note particularly that the diametrical width W of the cooking adapter's inner wall 40 is just slightly greater than the diameter D of the primary crown portion 24 of the lantern's cap 25, same being so sized to permit seating of the adapter on the brim 26 portion of the cap. Note further that the diametrical width W' of the sleeve's outer wall 35 is no greater than the diameter D' of the cap's brim portion 26. Therefore, and in use, the cooking adapter 10 is sized to be seated upon, and to interfit with, the crown 24 and brim 26 portions of the cap 25 of the gas fired lantern 11. As illustrated in FIG. 2, this interfitting and seating relationship of the cooking adapter 10 on the cap 25 of the lantern 11 prevents lateral or side-to-side motion (as indicated by directional arrow 45) of the cooking adapter relative to the lantern's vertical axis 46, and also supports the cooking adapter in vertical position on the lantern's cap relative to exhaust ports 28 in the cap. Further, and because the diameter D″ of the lantern's secondary crown or stack portion 27 is substantially less than the diameter D of the lantern's primary crown portion 24, heat exhausting from ports 28 in that stack is contained within the cooking adapter 10 and caused to flow upwardly against the underside of, for example, the pot 44 resting on the wire grid.

The cooking adapter 10 of this invention is quite simple and easy to use in that it requires no structural modifications of any type to the lantern 11. The cooking adapter 10 is simply seated on top the cap 25 of the lantern 11, and is adapted to interfit with the structural features of that cap so as to retain same in operative engagement with the lantern during cooking use.

Having described in detail the preferred embodiment of my invention, what I desire to claim and protect by Letters Patent is:

1. A cooking adapter for use with a gas fired lantern, said lantern including a cap mounted in an immobile position, said cap including a brim portion, a primary crown portion and a secondary crown portion, said secondary crown portion being of a lesser diameter than said primary crown portion, and said secondary crown portion having structure defining a plurality of exhaust ports therein, said cooking adapter comprising a tubular sleeve member sized to cooperate with said cap's primary crown and brim portions so as to retain said sleeve member in seated relation thereon during use without being secured thereto, and said sleeve member including a bottom edge adapted to seat against said brim portion to prevent axially downward motion of said cooking adapter relative to said lantern's vertical axis, and the inside periphery of said sleeve member cooperating with the exterior periphery of said primary crown portion to prevent lateral motion of said cooking adapter relative to said lantern's vertical axis, when said adapter is seated in operational relation on said cap, and a grid connected to said tubular sleeve, said grid being spaced from said sleeve member's bottom edge such that said secondary crown portion is positioned within said sleeve member but beneath said grid when said cooking adapter is seated in operational relation on said cap, and said grid being adapted to receive a cooking implement thereon in use.

2. A cooking adapter structure for use with a gas fired lantern, said structure comprising a cap for connection to said lantern, said cap including a brim portion, a primary crown portion, and a secondary crown portion, said secondary crown portion being of a lesser diameter than said primary crown portion, and said secondary crown portion having structure defining a plurality of exhaust ports therein, a tubular sleeve member sized to cooperate with said cap's primary crown and brim portions so as to retain said sleeve member in seated relation thereon during use without being secured thereto, and said sleeve member including a bottom edge adapted to seat against said brim portion to prevent axially downward motion of said cooking adapter relative to said lantern's vertical axis, and the inside periphery of said sleeve member cooperating with the exterior periphery of said primary crown portion to prevent lateral motion of said cooking adapter relative to said lantern's vertical axis, when said adapter is seated in operational relation on said cap, and a grid connected to said tubular sleeve, said grid being spaced from said sleeve member's bottom edge such that said secondary crown portion is positioned within said sleeve member but beneath said grid when said cooking adapter is seated in operational relation on said cap, and said grid being adapted to receive a cooking implement thereon in use.

3. A cooking adapter as set forth in claim 2, said sleeve including an insulated wall portion surrounding at least that portion thereof between said grid and said bottom edge.

4. A cooking adapter as set forth in claim 2 including structure defining a notch in the top edge of said sleeve, said grid being connected to said sleeve beneath said notch and between the top and bottom edges thereof, said notch being adapted to permit the handle of a cooking implement to extend outwardly beyond the periphery of said sleeve.

5. A cooking adapter as set forth in claim 1, said sleeve including an insulated wall portion surrounding at least that portion thereof between said grid and said bottom edge.

6. A cooking adapter as set forth in claim 1 including structure defining a notch in the top edge of said sleeve, said grid being connected to said sleeve beneath said notch and between the top and bottom edges thereof, said notch being adapted to permit the handle of a cooking implement to extend outwardly beyond the periphery of said sleeve.

* * * * *